US006254733B1

(12) United States Patent
Lu et al.

(10) Patent No.: US 6,254,733 B1
(45) Date of Patent: Jul. 3, 2001

(54) AUTOMATIC COVER REMOVAL SYSTEM

(75) Inventors: Jinyang Lu, Sugarland; Charles Schroeder, Humble, both of TX (US)

(73) Assignee: Hahn & Clay, Houston, TX (US)

( * ) Notice: Subject to any disclaimer, the term of this patent is extended or adjusted under 35 U.S.C. 154(b) by 0 days.

(21) Appl. No.: 09/388,359

(22) Filed: Sep. 1, 1999

(51) Int. Cl.[7] ..... C10B 1/04; C10B 25/10; C10B 25/20

(52) U.S. Cl. ..... 202/245; 202/242; 202/246; 48/124

(58) Field of Search ..... 202/242, 244, 202/245, 246, 214, 221, 243, 252, 270; 48/124; 220/329, 334, 337, 338; 49/463; 414/216, 684.3

(56) References Cited

U.S. PATENT DOCUMENTS

| | | | | |
|---|---|---|---|---|
| 4,960,358 | * | 10/1990 | DiGiacomo et al. | 414/684.3 |
| 5,098,524 | * | 3/1992 | Antalfy et al. | 202/96 |
| 5,785,843 | * | 7/1998 | Antalffy et al. | 208/131 |
| 5,947,674 | * | 9/1999 | Malsbury et al. | 414/216 |

* cited by examiner

*Primary Examiner*—Marian C. Knode
*Assistant Examiner*—Alexa A. Doroshenk
(74) *Attorney, Agent, or Firm*—Karen B. Tripp

(57) ABSTRACT

A system is disclosed for automatically removing the cover of a chute beneath a coke drum. The system operates in conjunction with a remotely operable coke deheading device so that the chute cover is removed when the coke drum is deheaded. Also disclosed is a method for facilitating coke removal from a coke drum into a coke chute where the chute cover is automatically removed upon activation of the coke drum deheading device.

7 Claims, 2 Drawing Sheets

AUTOMATIC COVER REMOVAL SYSTEM

BACKGROUND OF THE INVENTION

1. Field of the Invention

The present invention relates to drum deheading devices and associated systems involving containments for receiving materials from said drums. The invention has particular applicability to the removal of covers on chutes or pits or other containments for receiving coke from coke drums and is particularly suited for association with apparatuses and methods for remote deheading of coke drums.

2. Brief Description of Relevant Art

In the typical delayed coking process, high boiling petroleum residues are fed to a large upright vessel called a coke drum, where they are thermally cracked into light products and a residue, petroleum coke. This residue varies in consistency depending on the quality and composition of feedstock. The coke may be solid, spongy, shot or pellet-like, or even viscous liquid. When the drum is fill, the feed is diverted to an empty drum and the coke filled drum is steam purged and cooled with quench water. The drum is then drained of water and the top and bottom heads of the drum are removed for removing the coke from the drum. After the coke is removed, the drum is ready to be placed back in service to repeat the cycle.

How the coke is removed from the drum varies with the type and consistency of the coke. For example, solid coke may have to be drilled out whereas shot and liquid coke may fall out when the drum bottom head is removed. Even with steam purging and cooling with quench water, the coke is at a high temperature, typically exceeding 200 degrees Fahrenheit, when the drum heads are opened. The drum is also under pressure. When the drum is opened, hot steam and some hot coke typically pour out with force. For safety, the drum heads are opened remotely and the drum has a head or cover assembly suited for remote operation. An example of a suitable remotely operable vessel cover particularly useful for a coke drum is described in U.S. Pat. No. 5,221,019, assigned to Hahn and Clay in Houston, Tex.

In the typical coking process, the coke falling from the drum, or otherwise removed from the drum, goes into a chute where it is carried to a pit or other container for the coke. During the coking process, the opening to the chute is covered, typically with a cover, such as, for example, a grate, until the drum is ready for decoking. Removal of the cover is typically done manually. However, working in the vicinity of the bottom head of the coke drum is potentially hazardous. A typical chute can be many feet deep. There exists a need for safer processes that would not require manual removal of the chute cover.

SUMMARY OF THE INVENTION

A system is provided for covering and uncovering the opening of a chute, pit, containment vessel or other container or receiver for receiving material from a large vessel for industrial purposes, such as a drum or more particularly, for example, a coke drum used in petroleum refining processes. The drum is generally positioned above this receiver and is fitted with a remotely operable deheading device for opening the drum above the receiver, preferably automatically. An example of such a deheading device particularly suitable for use with the system of this invention is sold by Hahn and Clay in Houston, Tex. and is described in their "FACT System®" brochure. The system of this invention is particularly useful for association with drums that have limited space between the drum and the receiver, which, due to their uses or contents, beg remote operation for the safety of the personnel working in the vicinity of the drum.

In the system of the invention, a cover for the receiver is provided with a flexor, preferably, for example, a hinge, to enable the cover to bend or otherwise reduce its size, and particularly its horizontal width. Connectors attach the cover to extendible or retractable legs, which may be telescopic in nature. The legs preferably have pivots to accommodate changes in position of the cover caused by the flexor and the legs.

Connectors, which may be the same type or a different type from the connectors attaching the cover, attach the extendible legs to the head of the drum. The connection of the legs to the drum, and to the cover, is such that the legs retract and the flexor flexes the cover when the deheading device on the drum head is in operation to remove the drum head or dehead the drum. That is, the system of the invention preferably operates automatically, in association with the drum head as the drum head is removed from the drum by the deheading device. Thus, preferably, the legs retract as the flexor flexes the cover such that the cover is lifted and moved away from the opening of the receiver as the drum head is moved away from the opening of the drum, so material may fall from the drum into the receiver. This conjunctivity of operation between the drum head and the receiver cover is effected by attachment of the legs to the cover and to the drum (or drum head or drum deheading device). The system of this invention is thus preferably powered or controlled by operation of the drum deheading device.

The legs extend and the flexor straightens to replace the cover over the receiver as the drum head is returned to the drum. Preferably, a stop for the flexor helps determine the angle of flexion of the cover. The stop is attached to the drum head and stops the cover when the legs are retracted. The angle of flexion of the cover depends on the point or time in the retraction of the legs that the stop stops the flexor. The earlier the stop stops the flexor the less acute the angle the cover will bend or flex. The desired or necessary angle of flexion will depend on the a-mount of space between the drum and the receiver and also the size of the receiver cover. The larger the cover and the narrower the space between the drum and the receiver, generally the greater the flexion or bend of the cover will be needed. The effect of the flexion is to make the cover smaller in the sense that it can be lifted and swung away beneath the drum in conjunction with the drum head being swung away by a swing away drum deheading device.

In an alternative embodiment of the system of the invention, the cover is lifted and moved over instead of being swung away with the drum head.

Optionally or alternatively, the system may have its own individual controls, but preferably such controls should be set to work in conjunction with the operation of the drum head, so that, as the drum is opened and the drum head swings away or is otherwise removed or the drum is otherwise opened, the receiver cover is removed from the receiver and similarly swung away or moved. Such operation should be done remotely, and preferably automatically, rather than manually.

The system of this invention is useful with coke drums and a method is provided for facilitating coke removal from a coke drum into a coke receiver such as a chute, pit, or other containment vessel. As used herein, the term "chute" or "receivers" shall be understood to encompass all containers, receivers, or containment vessels or apparatuses for receiving and/or containing coke or other material from drums. The system and method are particularly useful as well for other large drums that may contain hot and /or hazardous materials, where the opening of the drum is best done remotely. Thus, as used herein, reference to"coke" drum shall be understood to include such other industrial drums that may contain hot and /or hazardous materials or any large industrial vessel whose contents are typically deposited into an underlying container.

In the method of this invention, a drum is fitted with a remotely operable drum head. The drum is positioned over the receiver for the drum's contents. The space between the drum and the receiver is large or wide enough to allow the drum head to be remotely opened and closed above the receiver. The drum head is connected to the cover of the receiver such that removal of the drum head causes removal of the cover from the receiver. The drum head is remotely operable, and as it is opened and swung away from the drum, the cover of the receiver is lifted and swung away to open the receiver for receiving the contents of the drum.

DETAILED DESCRIPTION OF THE PREFERRED EMBODIMENT OF THE INVENTION

Figure 1:
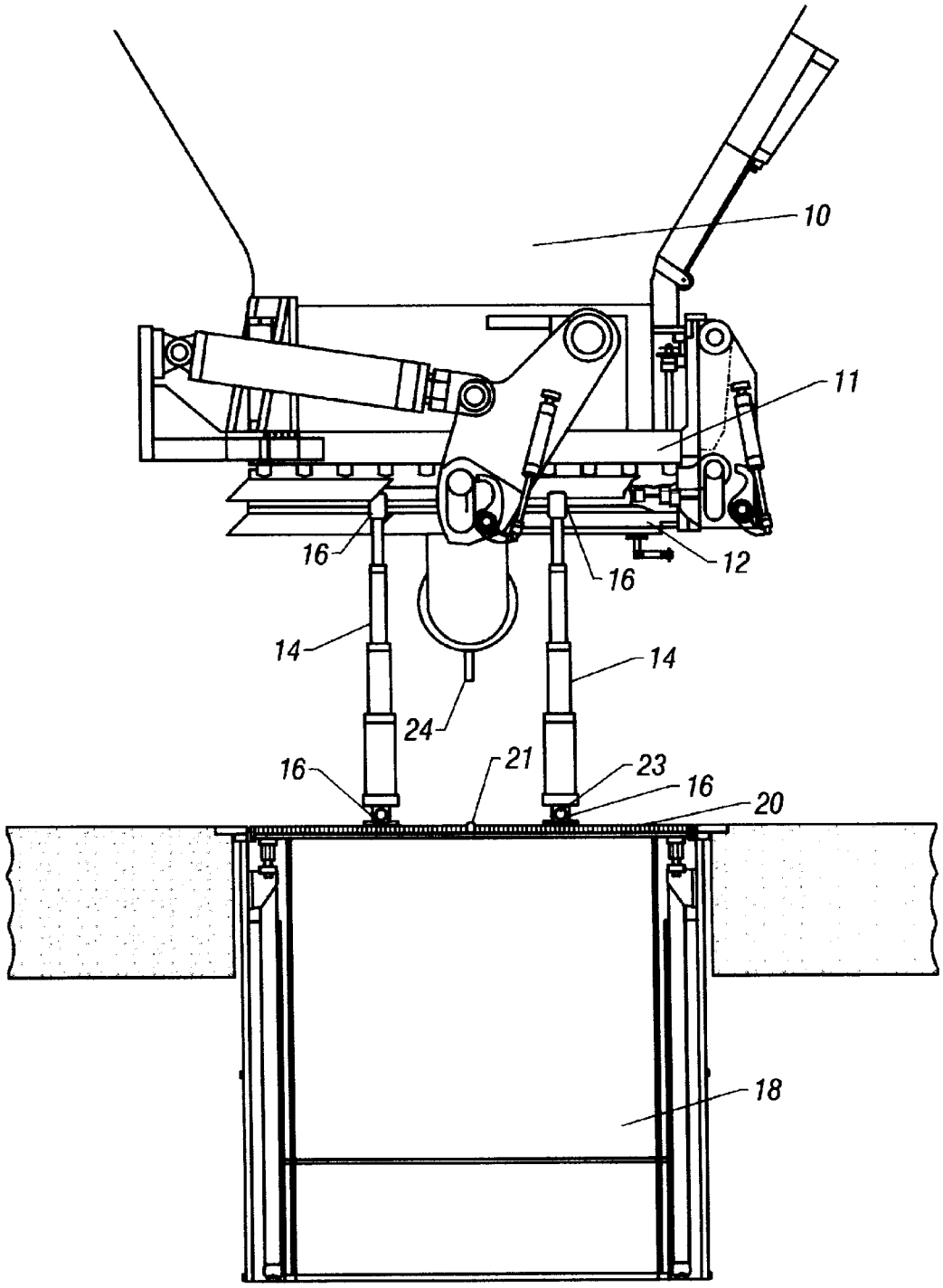
FIG. 1 shows a schematic of a system of this invention in a closed position.
Figure 2:
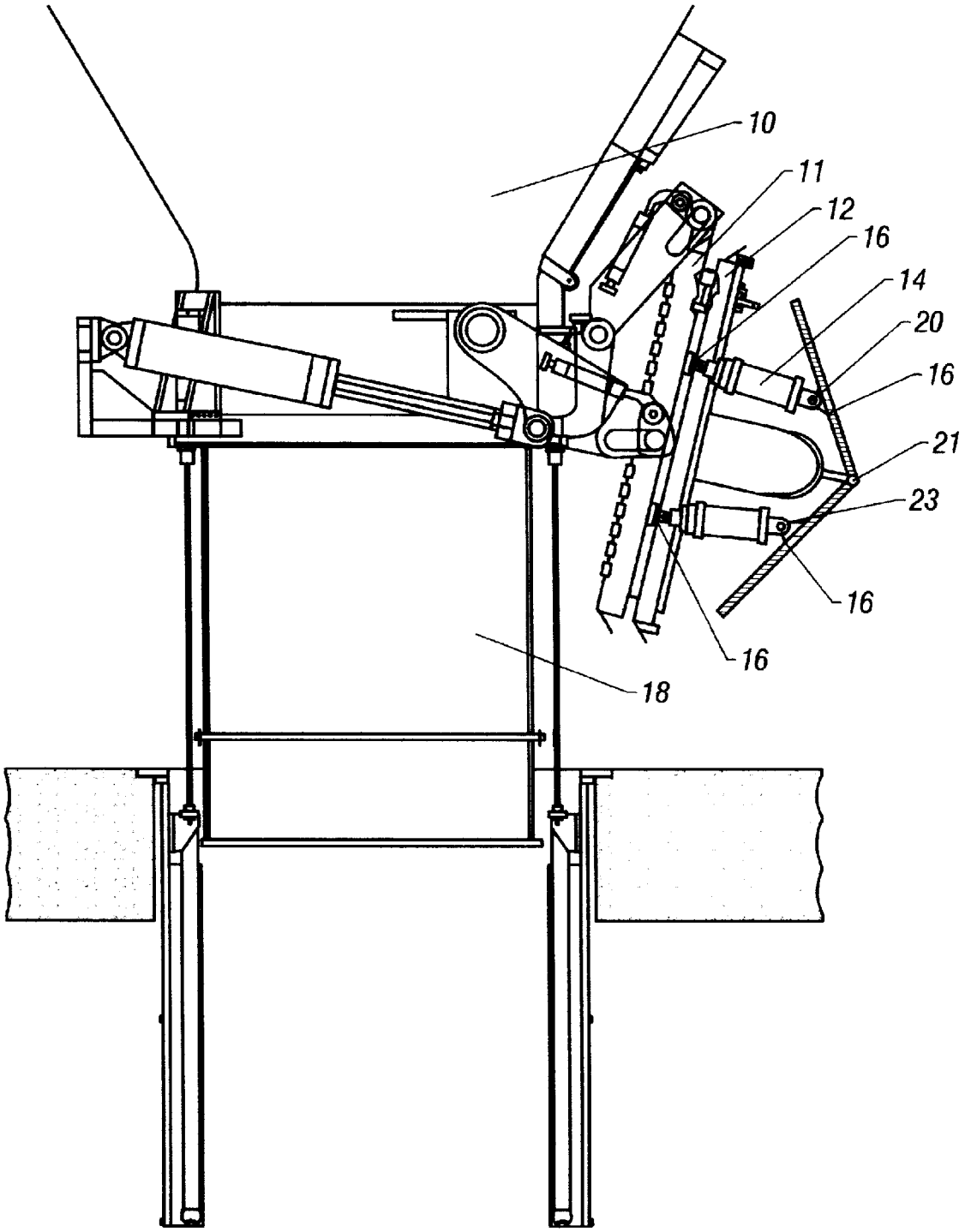
FIG. 2 shows a schematic of a system of this invention in an open position.

The invention may be better understood by referring to FIGS. 1 and 2 which show the system of the invention in a closed and open position respectively.

FIG. 1 shows the base or bottom of a drum 10 with its drum head 11 fitted with a remotely operable deheading device 12. Such device 12 may have, for example, a tractor drive double rack and pinion or hydraulic cylinder activation and is preferably operable remotely and automatically to open and close the drum head 11. Drum 10 is positioned above a receiver 18, which may be a chute or other containment vessel or apparatus for the contents of the drum. The receiver 18 has an opening covered by a cover 20, such as for example a grate, so that the contents of the drum may fall or be made to fall from the drum 10 into the receiver 18 when the drum head 11 is opened. Preferably cover 20 has at least one flexor 21 which allows the cover 20 to bend. A hinge is an example of a flexor 21 but any apparatus or characteristic that allows the cover 20 to bend or reduce its width may be used.

At least one leg 14 is attached at one end to the drum 10, drum head 11 or deheading device 12, and at the other end to the cover 20. Connectors 16 may be used to facilitate such attachment. Where a flexor 21 is positioned in the middle or center of the cover 20 as shown in FIGS. 1 and 2, preferably two legs 14 are attached to the cover 20 on opposing sides of the flexor 21. Preferably, the legs 14 are retractable or extendable, and may be telescopic. Pivots 23 may be associated with connectors 16 to facilitate or comprise the connection of legs 14 and the cover 20 to allow some flexibility in the position of the legs 14 with respect to the cover 20 so as to accommodate changes in position of the cover, as when the cover is swung away from or lifted and removed from the receiver 18.

When the legs 14 retract, the cover 20 lifts and is preferably swung away from or otherwise removed from receiver 18. Flexor 21 causes cover 20 to bend. Stop 24 halts the extent of the bend of cover 20. The amount of the bend is thus determined by when stop 24 halts the bend, as, for example, by touching the flexor 21. The bending or flexion of cover 20 makes its width smaller so it may be more easily swung away from the receiver 18 as the head 11 is swung away from drum 10. Where the distance between the drum 10 and the receiver 18 is sufficiently large to accommodate lifting and swinging away or other removal of the cover 20 from the receiver 18 Is without flexion of the cover 20, then the cover 20 need not have the ability to flex and bending of the cover 20 does not have to occur. Thus, the amount or extent of flexion of cover 20, if any, needed depends on the distance between the drum 10 and the receiver 18 and the manner that the cover is removed from the receiver.

Preferably, the retraction of the legs 14 and lifting and removal of cover 20 occur when the drum deheading device 12 is removing the drum head 11 from the drum 10. The retraction of the legs 14, which may be conducted, for example, hydraulically or mechanically, and automatically and remotely, can be associated with the operation of the deheading device 12 to assure conjuntivity of operation. In one preferred embodiment, the receiver 18 may also be designed so as to lift and meet the drum 10 when the cover 20 is removed from the receiver 18.

Alternatively, the legs 14 may have separate controls from the deheading device 12.

The cover 20 is replaced on receiver 18 by lifting or lowering or swinging it back in position above receiver 18 and extending legs 14. Preferably, such lifting or lowering and swinging back is at about the same time as the replacement of the drum head 11 on the drum 10 by the drum head deheading device 12.

Although the present invention and its advantages have been described, it should be understood that various changes, substitutions and alterations can be made without departing from the spirit and scope of the invention as defined by the following claims.

We claim:

1. An automatic apparatus for removing the cover of a receiver for receiving material from a drum with an opening fitted with a head associated with a remotely operable deheading device, comprising:

a cover which functions to cover an opening of the receiver;

said cover provided with at least one flexor which allows said cover to bend;

connectors with pivots for attaching said cover to extendable legs, wherein said connectors with pivots function to accommodate changes in position of the cover by movement of said flexor and said legs; and connectors for attaching said extendable legs to the head of said drum, such that said legs retract and said flexor flexes the cover such that the cover can be lifted and moved away from the opening of the receiver as said head is moved away from the opening of the drum by the deheading device so material may fall from the drum into the receiver.

2. The apparatus of claim 1 wherein said cover has a flexor for reducing the horizontal width of said cover and wherein the system further comprises a stop for effecting the angle of flexion of said cover.

3. The apparatus of claim 2 wherein said flexor is a hinge.

4. The apparatus of claim 1 wherein said legs are telescopic.

5. The apparatus of claim 1 wherein said drum is a coke drum.

6. The apparatus of claim 1 wherein said receiver is a chute.

7. The apparatus of claim 1 wherein said legs extend and said flexor straightens to return the cover to the receiver.

* * * * *